US006975162B2

(12) United States Patent
Tamura et al.

(10) Patent No.: US 6,975,162 B2
(45) Date of Patent: Dec. 13, 2005

(54) CONSTANT CURRENT DRIVING CIRCUIT

(75) Inventors: Yuji Tamura, Yokohama (JP); Tomoyuki Otsuka, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/094,535

(22) Filed: Mar. 31, 2005

(65) Prior Publication Data

US 2005/0168269 A1 Aug. 4, 2005

Related U.S. Application Data

(63) Continuation of application No. PCT/JP03/002658, filed on Mar. 6, 2003.

(51) Int. Cl.[7] ..... G05F 1/10; G05F 3/04
(52) U.S. Cl. ..... 327/538; 323/312
(58) Field of Search ..... 323/268, 270, 323/271, 273, 275, 280–282, 285, 311, 312; 327/108, 355, 363, 538, 542–546

(56) References Cited

U.S. PATENT DOCUMENTS

| | | | | |
|---|---|---|---|---|
| 5,309,082 A | | 5/1994 | Payne | |
| 5,422,562 A | | 6/1995 | Mammano et al. | |
| 5,926,384 A | | 7/1999 | Jochum et al. | |
| 5,939,937 A | * | 8/1999 | Terletzki | 327/541 |
| 5,990,711 A | * | 11/1999 | Sekimoto | 327/112 |
| 6,037,832 A | * | 3/2000 | Kaminishi | 327/538 |
| 6,466,080 B2 | * | 10/2002 | Kawai et al. | 327/538 |

FOREIGN PATENT DOCUMENTS

| | | |
|---|---|---|
| JP | 04-130506 A | 5/1992 |
| JP | 2000-089837 A | 3/2000 |

* cited by examiner

*Primary Examiner*—Matthew V. Nguyen
(74) *Attorney, Agent, or Firm*—Staas & Halsey LLP

(57) ABSTRACT

A constant current driving circuit for supplying a constant current to a load circuit includes: a first driver circuit having a pulse width converting circuit for converting a first difference detection signal into a pulse signal having a pulse width corresponding to a signal level of the first difference detection signal, a switch turned on/off on a basis of the pulse signal, and a smoothing circuit for supplying a smoothed first load current to the load circuit; a first current detecting circuit for converting the first load current into a first voltage corresponding to the first load current, and outputting a first current detection signal; a second driver circuit for supplying a second load current to the load circuit on a basis of a signal level of a second difference detection signal; a second current detecting circuit for converting the second load current into a second voltage corresponding to the second load current, and outputting a second current detection signal; a first difference detecting circuit for calculating the first difference detection signal to make zero a difference between the first current detection signal and an input voltage; a second difference detecting circuit for detecting a difference voltage between the first current detection signal and the input voltage, and outputting a third difference detection signal; and a third difference detecting circuit for detecting a difference voltage between the third difference detection signal and the second current detection signal, and outputting the second difference detection signal.

21 Claims, 13 Drawing Sheets

CONSTANT CURRENT DRIVING CIRCUIT

CROSS REFERENCE TO RELATED APPLICATIONS

This is a continuing application, filed under 35 U.S.C. §111 (a), of International Application PCT/JP2003/002658, filed Mar. 6, 2003.

BACKGROUND OF THE INVENTION

1. Field of the Invention

The present invention relates to a constant current driving circuit used in an optical communication device, an optical system, and the like.

2. Description of the Related Art

An example of circuit configuration using device characteristics, an example of a high-precision circuit, an example of high-precision and low-power-consumption configuration, and the like are generally used for constant current driving circuits.

(1) Example of Circuit Configuration Using Device Characteristics

FIG. 13A and FIG. 13B are diagrams showing a conventional example of circuit configuration of a constant current driving circuit using device characteristics. FIG. 13A shows an example of configuration using a FET. FIG. 13B shows an example of configuration using a bipolar transistor. As shown in FIG. 13A, the constant current driving circuit has an N-type FET (NFET) 6 and a load 8 connected in series with each other between a power supply 2 and a ground 4. An input voltage 10 is connected between a source and a gate of the NFET 6 to apply a constant source-to-gate voltage, so that a constant current flows from the power supply 2 to the load 8 side.

On the other hand, the constant current driving circuit shown in FIG. 13B has a load 14, an NPN transistor (Tr) 16, and a resistance 18 connected in series with each other between a power supply 10 and a ground 12. An input voltage 20 is connected between a base of the Tr 16 and the ground, so that a constant current flows from the power supply 10 through the load 14, the Tr 16, and the resistance 18 to the ground 12 side.

(2) Example of High-Precision Circuit

FIG. 14 is a diagram showing an example of a high-precision circuit as a conventional constant current driving circuit. As shown in FIG. 14, an NPN transistor (Tr) 24, a load 26, and a resistance 28 are connected in series with each other between a power supply 20 and a ground 22. An input voltage is connected to a plus terminal of a differential amplifier 30, and one terminal of a monitoring resistance 28 having another terminal grounded is connected to a minus terminal of the differential amplifier 30. The differential amplifier 30 applies a control voltage to a base of the transistor 24 such that a load current flowing through the load 26 is a constant current.

(3) Example of High-Precision and Low-Power-Consumption Circuit

FIG. 15 is a diagram showing an example of a high-precision and low-power-consumption circuit as a conventional constant current driving circuit. As shown in FIG. 15, a PFET 44 and a diode 46 are connected in series with each other between a power supply 40 and a ground 42. A coil 48, a load 50, and a monitoring resistance 52 are connected in series with each other between a drain of the PFET 44 and the ground 42. The diode 46 has an anode connected to the ground 42, and a cathode connected to the drain of the PFET 44. A differential amplifier 54 has a minus side connected to one terminal of the monitoring resistance 52, a plus side connected to an input voltage Vin, and an output side connected to a minus side of a comparator 56. A plus terminal of the comparator 56 is connected with an output side of a triangular wave generator circuit 58. The differential amplifier 54 obtains a difference between the input voltage and a voltage corresponding to a driving current. The difference is converted by the triangular wave generator circuit 58 and the comparator 56 into pulse width corresponding to the output voltage level of the differential amplifier 54. The pulse signal is output to a gate of the FET 44. When a high level is applied to the gate of the FET 44, the FET 44 is turned off, and when a low level is applied to the gate of the FET 44, the FET 44 is turned on. The FET 44 is turned off for a time corresponding to the pulse width. When the PFET 44 is turned on, a load current flows from the power supply 40 side through the FET 44, the coil 48, the load 50, and the monitoring resistance 52 to the ground 42.

When the PFET 44 is turned off, a potential at a point of connection of the coil 48 with the FET 44 is decreased to turn on the diode 46. A load current flows from the ground 42 side through the coil 48 to the load 50 side, whereby the load current is smoothed. The pulse signal is applied to the gate of the FET 44 so as to make the load current constant, whereby the load current converges at a constant current.

However, the conventional constant current driving circuits have the following problems. The examples of circuit configuration using device characteristics shown in FIG. 13A and FIG. 13B use individual characteristics of the devices being used which characteristics represent a relation between current and voltage. While the circuit configurations are simple, the circuit configurations have a problem in that the load current varies depending on individual variations and changes in the environment such as temperature and the like. The example of the high-precision circuit shown in FIG. 14 generates a current monitoring voltage by the current monitoring resistance, and supplies a high-precision load current by suppressing dependence on the device being used by negative feedback. Since the control transistor controls the load current by consuming power, the high-precision circuit has a problem of high power consumption by the circuit. The example of the high-precision and low-power-consumption circuit shown in FIG. 15 is also capable of high-precision control by negative feedback as in the example of the high-precision circuit. The high-precision and low-power-consumption circuit is configured to perform pulse control of the control device (FET 44), and thereby the control device performs only switching operation to suppress power consumption of the control device. However, the high-precision and low-power-consumption circuit has a slow response speed and is thus unable to respond quickly.

Thus, in the circuit configuration using device characteristics and the high-precision circuit, the same current as the supply current flows through each transistor. Hence power consumption of a combination of the circuit and the load is Power supply voltage×Supply current. Thus there is a circuit power consumption depending on the power supply voltage in addition to power consumption by the load. This circuit power consumption is unnecessary power consumption. The power consumption of an ideal high-precision and low-power-consumption circuit excluding the load and the monitoring resistance is zero, and thus the high-precision and low-power-consumption circuit is ideal in terms of power consumption. However, since the pulse waveform is smoothed by the diode and the coil, the high-precision and low-power-consumption circuit is not capable of quick response in at least a pulse period or more.

SUMMARY OF THE INVENTION

It is accordingly an object of the present invention to provide a constant current circuit that has a circuit configuration that reduces power consumption while maintaining a quick response characteristic, and suppresses unnecessary circuit power consumption, and to provide an optical communication system that suppresses increase in power supply power and thus requires a minimum heat radiation structure by using the constant current circuit.

In accordance with an aspect of the present invention, there is provided a constant current driving circuit for supplying a constant current to a load circuit, the constant current driving circuit including: a first driver circuit having a pulse width converting circuit for converting a first difference detection signal into a pulse signal having a pulse width corresponding to a signal level of the first difference detection signal, a switch turned on/off on a basis of the pulse signal, and a smoothing circuit for supplying a smoothed first load current to the load circuit; a first current detecting circuit for converting the first load current into a first voltage corresponding to the first load current, and outputting a first current detection signal; a second driver circuit for supplying a second load current to the load circuit on a basis of a signal level of a second difference detection signal; a second current detecting circuit for converting the second load current into a second voltage corresponding to the second load current, and outputting a second current detection signal; a first difference detecting circuit for calculating the first difference detection signal to make zero a difference between the first current detection signal and an input voltage; a second difference detecting circuit for detecting a difference voltage between the first current detection signal and the input voltage, and outputting a third difference detection signal; and a third difference detecting circuit for detecting a difference voltage between the third difference detection signal and the second current detection signal, and outputting the second difference detection signal.

In accordance with another aspect of the present invention, there is provided a constant current driving circuit for supplying a constant current to a load circuit, the constant current driving circuit including: a first driver circuit having a pulse width converting circuit for converting a first difference detection signal into a pulse signal having a pulse width corresponding to a signal level of the first difference detection signal, a switch turned on/off on a basis of the pulse signal, and a smoothing circuit for supplying a smoothed first load current to the load circuit; a first current detecting circuit for converting the first load current into a first voltage corresponding to the first load current, and outputting a first current detection signal; a second driver circuit for supplying a second load current to the load circuit on a basis of a signal level of a second difference detection signal; a second current detecting circuit for converting a combined load current of the first load current and the second load current into a second voltage corresponding to the combined load current of the first load current and the second load current, and outputting a second current detection signal; a first difference detecting circuit for calculating the first difference detection signal to make zero a difference between the first current detection signal and an input voltage; and a second difference detecting circuit for detecting a difference voltage between the first difference detection signal and the second current detection signal, and outputting the second difference detection signal.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
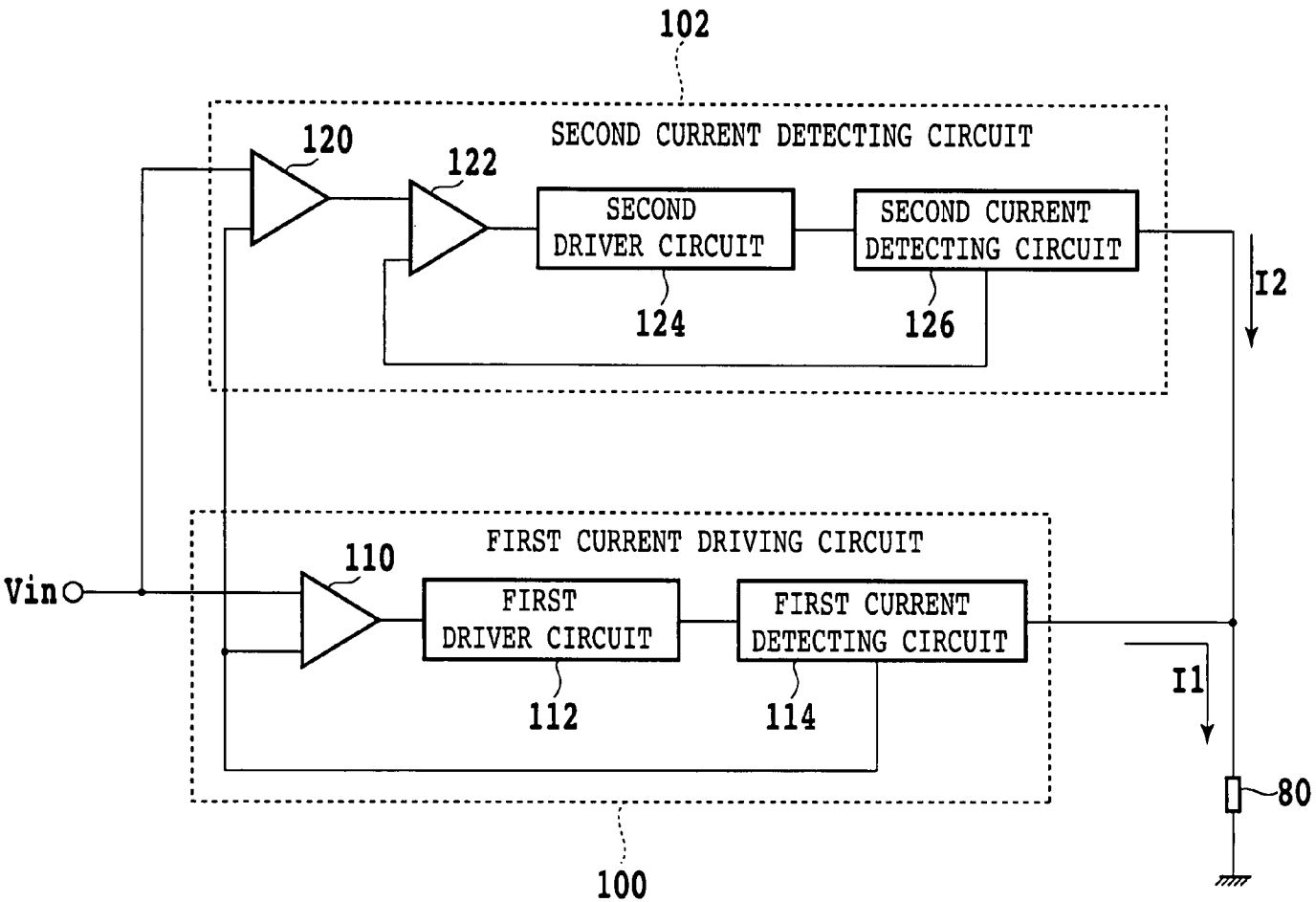
FIG. 1 is a diagram of assistance in explaining a first principle of the present invention.

Principles of the present invention will be described prior to description of embodiments of the present invention. FIG. 1 is a diagram of assistance in explaining a first principle of the present invention. As shown in FIG. 1, a constant current driving circuit includes a first current driving circuit 100 and a second current driving circuit 102. The first current driving circuit 100 has a first difference detecting circuit 110, a first driver circuit 112, and a first current detecting circuit 114. The second current driving circuit 102 has a second difference detecting circuit 120, a third difference detecting circuit 122, a second driver circuit 124, and a second current detecting circuit 126. The first difference detecting circuit 110 outputs a first difference detection signal to make zero a difference between an input voltage Vi and a first current detection signal representing a voltage corresponding to a first driving current I1 of the first driver circuit 112, the first current detection signal being generated by the first current detecting circuit 114.

The first driver circuit 112 supplies a load 80 with the first driving current I1 in accordance with the first difference detection signal. The first current detecting circuit 114 outputs the first current detection signal, which is the voltage corresponding to the first driving current I1, to the first difference detecting circuit 110. Thereby the first driving current I1 is controlled so as to coincide with a constant current corresponding to the input voltage Vi. In this case, suppose that the first driver circuit 112 is a circuit that consumes low power but cannot follow change in the input voltage Vi quickly.

The second difference detecting circuit 120 calculates a difference between the input voltage Vi and the first current detection signal, and then outputs a second difference detection signal. The third difference detecting circuit 122 calculates a difference between the second difference detection signal and a second current detection signal representing a voltage corresponding to a second driving current I2 of the second driver circuit 124, and then outputs a third difference detection signal. The third difference detection signal indicates an amount by which a combined current obtained by combining the first driving current I1 and the second driving current with each other is short or excessive as compared with the constant current. The second driver circuit 124 increases/decreases the second driving current I2 according to the third difference detection signal. In this case, supposing that the second driver circuit 124 can follow change in the third difference detection signal quickly, the combined current of the first driving current and the second driving current quickly coincides with the constant current even when the first driving current cannot coincide with the constant current because of the low speed of the first driver circuit 112. When the first driving current I1 coincides with the current corresponding to the input voltage Vi, the second driving current I2 becomes zero, and the second driver circuit 124 does not consume power.

Figure 2:
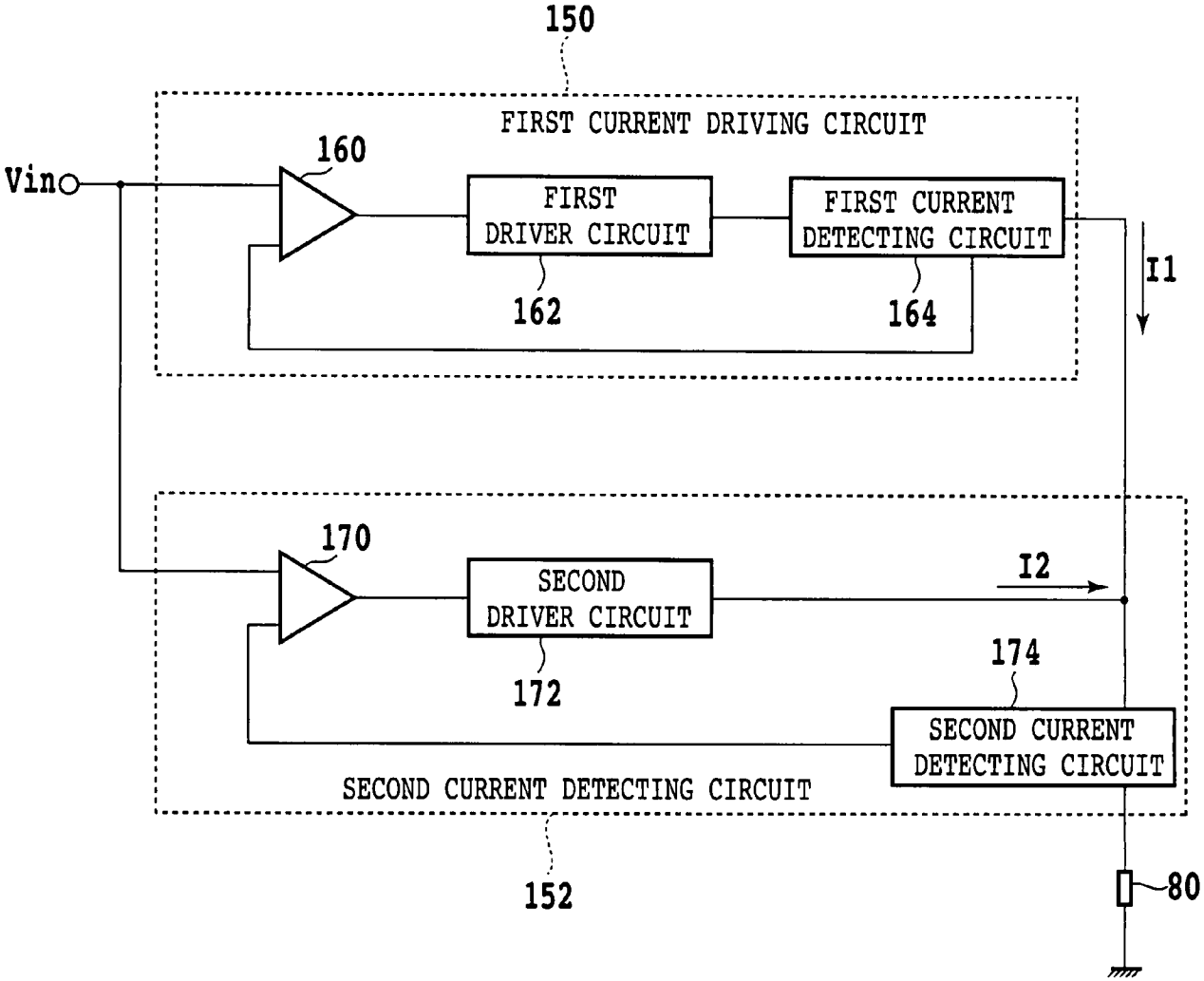
FIG. 2 is a diagram of assistance in explaining a second principle of the present invention.

FIG. 2 is a diagram of assistance in explaining a second principle of the present invention. As shown in FIG. 2, a constant current driving circuit includes a first current driving circuit 150 and a second current driving circuit 152. The first current driving circuit 150 has a first difference detecting circuit 160, a first driver circuit 162, and a first current detecting circuit 164. The second current driving circuit 152 has a second difference detecting circuit 170, a second driver circuit 172, and a second current detecting circuit 174. The first difference detecting circuit 160 outputs a first difference detection signal to make zero a difference between an input voltage Vi and a first current detection signal representing a voltage corresponding to a first driving current I1 of the first driver circuit 162, the first current detection signal being generated by the first current detecting circuit 164. The first driver circuit 162 outputs the first driving current I1 in accordance with the first difference detection signal. The first current detecting circuit 164 outputs the first current detection signal representing the voltage corresponding to the first driving current I1 to the first difference detecting circuit 160.

The second difference detecting circuit 170 calculates a difference between the input voltage Vi and a second current detection signal representing a voltage corresponding to a combined current of the first driving current I1 and a second driving current I2, and then outputs a second difference detection signal. The second driver circuit 172 increases/decreases the second driving current I2 according to the second difference detection signal. Thereby, when the first driving current I1 is short/excessive as compared with a constant current, the second driving current I2 flows to a load 80 so as to compensate for the shortage/excess. Therefore the combined current of the first driving current I1 and the second driving current I2 quickly coincides with the constant current corresponding to the input voltage Vi. Also, when the first driving current I1 coincides with the constant current, the second driving current I2 is controlled to become zero, and therefore the first driver circuit 162 stops operation to suppress power consumption.

First Embodiment

Figure 3:
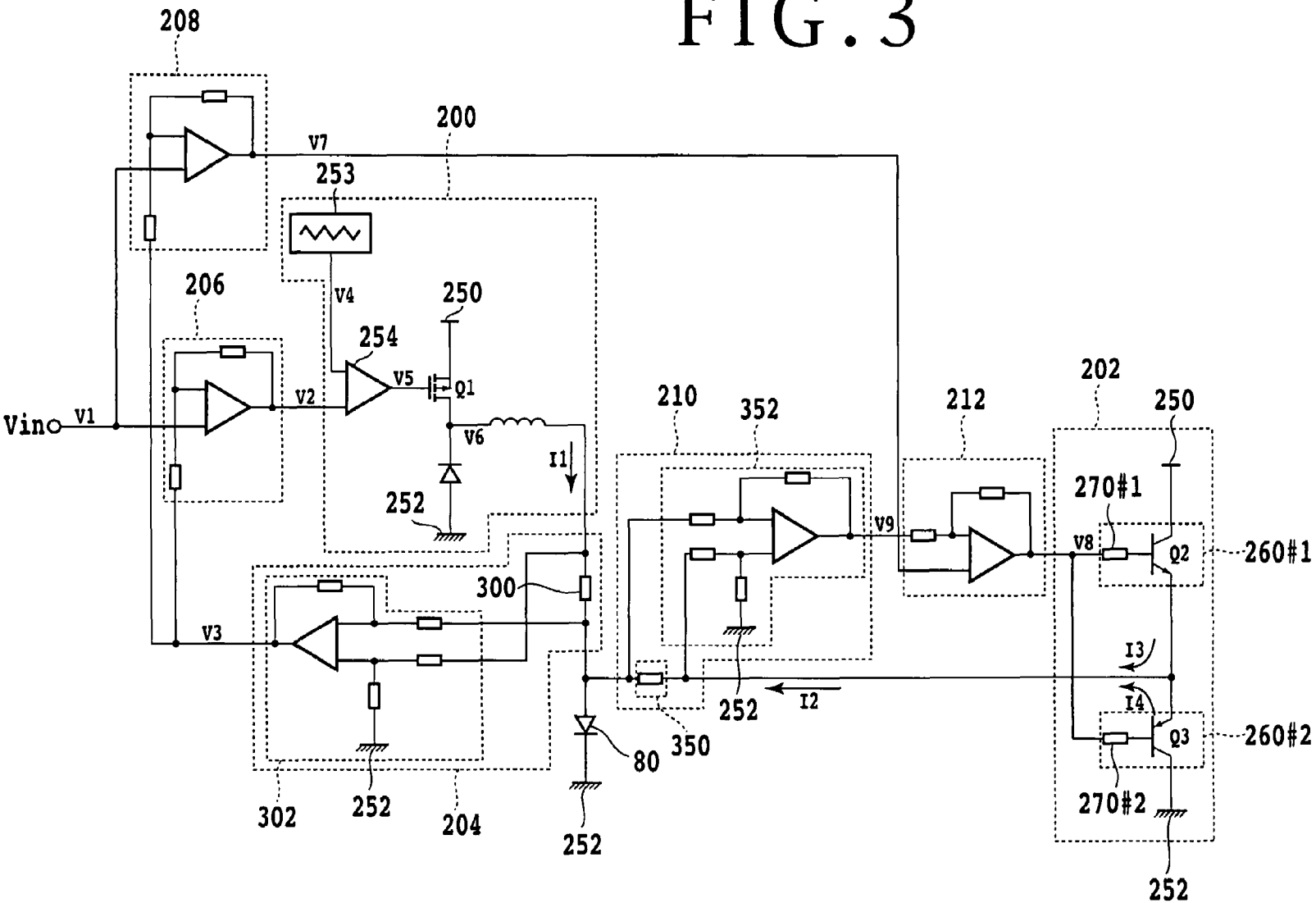
FIG. 3 is a diagram of a configuration of a constant current driving circuit according to a first embodiment of the present invention.

FIG. 3 is a diagram of a configuration of a constant current driving circuit according to a first embodiment of the present invention. As shown in FIG. 3, the constant current driving circuit includes a first driver circuit 200, a second driver circuit 202, a first current detecting circuit 204, a first difference detecting circuit 206, a second difference detecting circuit 208, a second current detecting circuit 210, and a third difference detecting circuit 212.

The first driver circuit 200 is a low-consumption constant current driving circuit. The first driver circuit 200 has a triangular wave generator 253, a comparator 254, a PFET (switch) Q1, a choke coil L, and a diode D. The triangular wave generator 253 is a circuit for generating a triangular wave V4 having a predetermined cycle in a certain voltage range (for example 0V to +5 V). The comparator 254 compares the voltage level of the triangular wave V4 input to a plus terminal of the comparator 254 with the voltage level of a first difference detection signal V2 input to a minus terminal of the comparator 254 as an output signal of the first difference detecting circuit 206. The comparator 254 outputs a pulse signal V5 that has a high level when the voltage level of the triangular wave V4 is high and has a low level when the voltage level of the first difference detection signal V2 is high. The comparator 254 thus outputs the pulse signal V5 whose pulse width corresponds to the voltage level of the first difference detection signal V2. The triangular wave generator circuit 253 and the comparator 254 are a pulse width converter. The switch Q1 is turned off when the pulse signal V5 is high and is turned on when the pulse signal V5 is low. The switch Q1 is for example a PFET having a gate supplied with the pulse signal V5 and a source connected to a power supply 200. The transistor Q1 is a circuit element intended to perform ON/OFF operation. Any of transistor elements of a MOS structure and a bipolar structure is applicable as the transistor Q1. The choke coil L and the diode D are a circuit for smoothing a driving current to be supplied to a load 80. The choke coil L has one terminal connected to a drain of the FET Q1 and another terminal connected to the first current detecting circuit 204. The choke coil L accumulates electric energy when the switch Q1 is on. When the switch Q1 is turned off, a voltage V6 of the terminal connected to the switch Q1 is decreased to turn on the diode D. The electric energy is released to the load 80 side, and the driving current I1 is smoothed. The diode D is a circuit element that is turned off when the switch Q1 is on and is turned on when the switch Q1 is turned off to secure a return current path for releasing the electric energy accumulated in the choke coil L from a ground 252 to the load 80. An element having the same function can be applied as the diode D. A capacitance (capacitor) for a purpose of smoothing the current may be connected in the path of the first driving current I1.

The second driver circuit 202 supplies a second driving current corresponding to the voltage of a third difference detection signal V8, and absorbs a part of the first driving current I1. The second driver circuit 202 has a first transistor 260#1 and a second transistor 260#2. The first transistor 260#1 is a circuit that supplies a current I3 corresponding to the value of the third difference detection signal V8 to the load 80 when the third difference detection signal V8 is positive and stops the supply of the current I3 when the third difference detection signal V8 is negative. For example, the first transistor 260#1 includes a base resistance 270#1 having one end connected to an output side of the third difference detecting circuit 212 and another end connected to a base of a transistor Q2, and the NPN transistor Q2 having a collector connected to the power supply 250 and an emitter connected to an input side of the second current detecting circuit 210.

The second transistor 260#2 is a circuit that absorbs a current (in a direction opposite from a current I4) corresponding to the value of the third difference detection signal V8 which current is a part of the driving current I1 into the ground 252 side when the third difference detection signal V8 is negative and stops the absorption of the current I4 when the third difference detection signal V8 is positive. For example, the second transistor 260#2 includes a base resistance 270#2 having one end connected to the output side of the third difference detecting circuit 212 and another end connected to a base of a transistor Q3, and the NPN transistor Q3 having an emitter connected to the input side of the second current detecting circuit 210 and a collector connected to the ground 252. That is, a short current is controlled by the first transistor 260#1, and an excessive current is controlled by the second transistor 260#2. Incidentally, the transistors Q2 and Q3 are not limited to bipolar transistors, and may be other circuit elements such as MOS transistors or the like as long as the circuit elements perform the above functions. In addition, for a purpose of reducing non-operating voltage of the transistors Q2 and Q3, a diode may be added between the third difference detecting circuit 212 and the base resistance 270#2 or between the base resistance 270#2 and the base of the transistor Q3.

The first current detecting circuit 204 detects the first driving current I1 generated by the first driver circuit 200, and then outputs a first current detection signal V3. The first current detecting circuit 204 includes a monitoring resistance 300 and an operational amplifier 302. The resistance 300 is a monitoring resistance that converts the driving current I1 into a voltage. The operational amplifier 302 calculates a potential difference across the monitoring resistance 300 to output the first current detection signal V3.

The first difference detecting circuit 206 outputs the first difference detection signal V2 to make zero a difference between an input voltage V1 and the first current detection signal V3. The first difference detecting circuit 206 is for example a differential amplifier that is supplied with the input voltage V1 at a plus terminal thereof and with the first current detection signal V3 at a minus terminal thereof and calculates a difference between the input voltage V1 and the first current detection signal V3. The circuit 206 outputs the first difference detection signal V2 so as to make zero the difference between the input voltage V1 and the first current detection signal V3, and an operation is assumed in which the first driving current I1 is increased with increase in the voltage V2 starting with a state of V2=0 and I1=0. Therefore, since after the first driving current I1 becomes a constant current and is fixed, the driver circuit 200 needs to maintain the constant current I1, the first difference detection signal V2 has a certain voltage rather than zero voltage even in the constant state.

The second difference detecting circuit 208 calculates a difference between the input voltage V1 and the first current detection signal V3 to output a second difference detection signal V7. The second difference detecting circuit 208 is for example a differential amplifier that is supplied with the input voltage V1 at a plus terminal thereof and with the first current detection signal V3 at a minus terminal thereof and calculates a difference between the input voltage V1 and the first current detection signal V3. The first difference detecting circuit 206 and the second difference detecting circuit 208 are of the same circuit structure but for different purposes. For example, when the first driving current I1 becomes a constant current and is thus fixed, the first difference detection signal V2 is not zero because the first driver circuit 200 needs to maintain the constant current I1, whereas the second difference detection signal V7 becomes zero because the second driver circuit 202 does not need to be driven.

The second current detecting circuit 210 outputs a second current detection signal V9 indicating a voltage corresponding to the driving current I2 generated by the second driver circuit 202. The second current detecting circuit 210 for example includes a monitoring resistance 350 and an operational amplifier 352. The resistance 350 is a monitoring resistance that converts the driving current I2 into a voltage. The operational amplifier 352 calculates a potential difference across the monitoring resistance 350 to output the second current detection signal V9.

Figure 4:
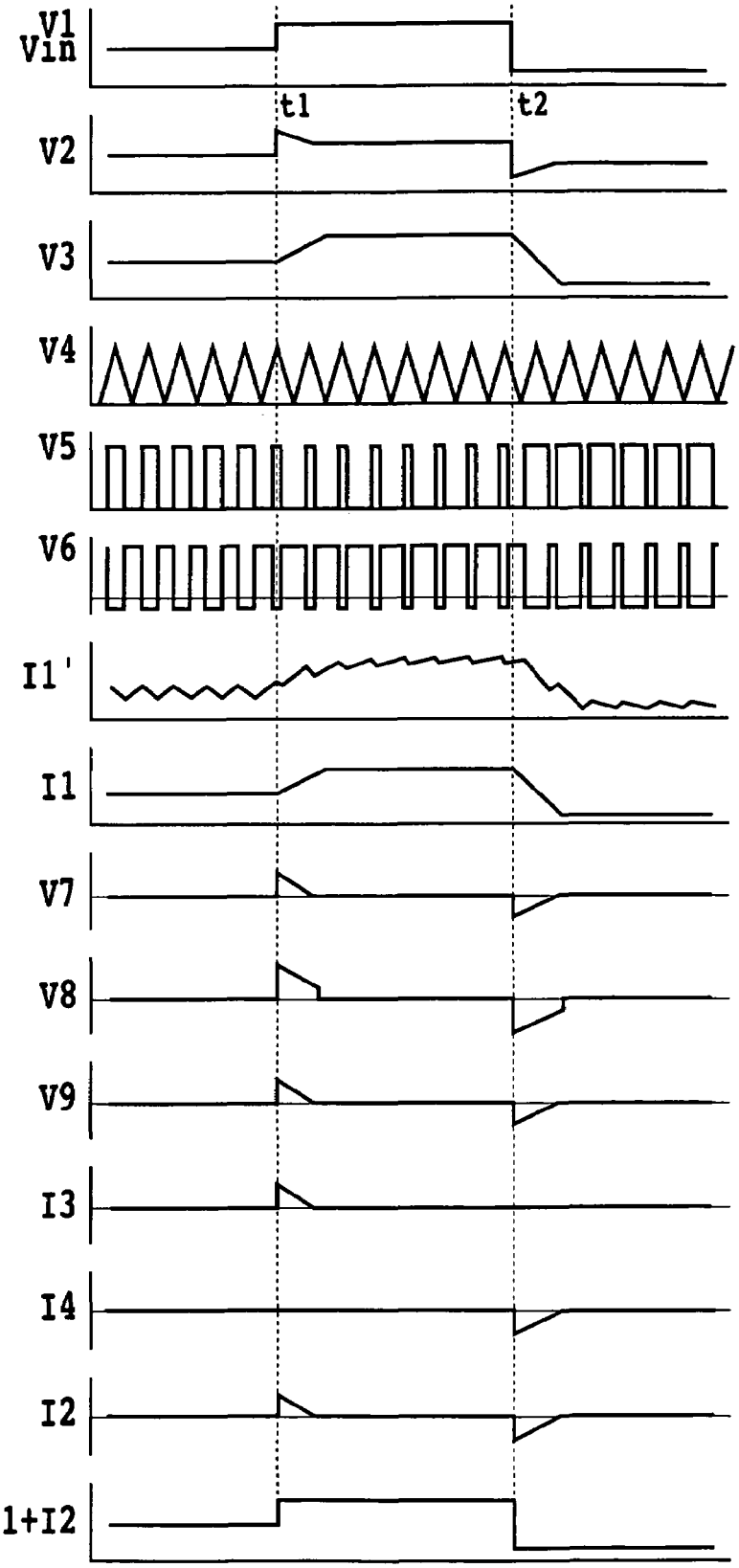
FIG. 4 is a timing chart of FIG. 3.

The third difference detecting circuit 212 calculates a potential difference between the second difference detection signal V7 and the second current detection signal V9 to output the third difference detection signal V8. The second difference detection signal V7 is a difference voltage between the input voltage V1 and the first current detection signal V3, that is, a voltage corresponding to a shortage current or an excess current of the driving current generated by the first driver circuit 200. The voltage V9 corresponding to the driving current I2 generated by the second driver circuit 202 is subtracted from the second difference detection signal V7 to calculate the driving current I2 to be generated by the second driver circuit 202. The load 80 is a laser diode or the like. The load 80 has one terminal (positive side) connected to an output side of the constant current driving circuit, and another terminal (negative side) connected to the ground 252. FIG. 4 is a timing chart of FIG. 3. Operation in FIG. 3 will be described in the following with reference to FIG. 4.

(1) Driving Current I1

As shown in FIG. 3, the input voltage V1 is input to the first difference detecting circuit 206 and the second difference detecting circuit 208. Suppose in this case that the input voltage V1 rises at time t1 and falls at time t2. The first current detecting circuit 204 inputs the first current detection signal V3 as shown in FIG. 3 to the first difference detecting circuit 206 and the second difference detecting circuit 208. The first difference detecting circuit 206 outputs the first difference detection signal V2 to make zero the difference between the input voltage Vi and the signal V3. The second difference detecting circuit 208 calculates the difference between the input voltage V1 and the voltage of the signal V3 to output the second difference detection signal V7.

The triangular wave generator 253 generates the triangular wave V4 in predetermined cycles. The comparator 254 compares the triangular wave V4 with the signal V2. The comparator 254 then outputs the pulse signal V5 that is high when V4>V2 and is low when V4≦V2 to the gate of the PFET Q1. When the pulse signal V5 is low, the PFET Q1 is turned on to supply the driving current I1 to the load 80 side via the choke coil L and the resistance 300. I1' is an accurate waveform, and I1 is a smoothed waveform. At this time, the diode D is off because the diode D is reverse-biased. When the pulse signal V5 is high, the PFET Q1 is turned off. Then, the voltage V6 on the PFET Q1 side of the choke coil L is decreased to forward bias and thus turn on the diode D. The electric energy accumulated in the choke coil L is released to the load 80 side via the ground 252, the choke coil L, and the monitoring resistance 300, and thus the driving current I1 is smoothed. The first current detecting circuit 204 converts the driving current I1 into a voltage, and then outputs the voltage to the first difference detecting circuit 206 and the second difference detecting circuit 208, whereby the driving current I1 is controlled to converge at a constant current. However, depending on inductance of the choke coil L, the driving current I1 cannot respond quickly to change in the input voltage V1, so that a difference occurs between the changed input voltage Vin and the driving current I1 as shown in FIG. 4.

(2) Driving Current I2

The difference voltage between the input voltage V1 and the first current detection signal V3 is the second difference detection signal V7, which is input to the third difference detecting circuit 212. The second current detecting circuit 210 outputs the second current detection signal V9 obtained by converting the driving current I2 into voltage to the third difference detecting circuit 212. The third difference detecting circuit 212 compares the second difference detection signal V7 with the second current detection signal V9, and then outputs the voltage V8 to make zero the difference between the second difference detection signal V7 and the second current detection signal V9 to the bases of the transistors Q2 and Q3. The difference voltage V8 corresponds to a current shortage/excess to be controlled by the second current I2. As shown in FIG. 4, the difference voltage V8 is a positive value at the time of a short current (for example at the time of a rising edge of the input voltage Vin) and is a negative value at the time of an excessive current (for example at the time of a falling edge of the input voltage Vin).

As shown in FIG. 4, when the base voltage of the transistor Q2 becomes positive (for example at the time of a rising edge of the input voltage Vin), the transistor Q2 is turned on to supply the current I3 to the load 80 side, and when the base voltage of the transistor Q2 becomes negative or zero (for example at the time of a falling edge of the input voltage Vin), the transistor Q2 is turned off to stop the supply of the current I3. On the other hand, as shown in FIG. 4, when the base voltage of the transistor Q3 becomes negative, the transistor Q3 is turned on to absorb the current I4 as part of the current I1, and when the base voltage of the transistor Q3 becomes positive or zero, the transistor Q3 is turned off to stop the absorption of the current I4. That is, when the first driving current I1 is short, the current I3 (current I2) flows from the transistor Q2, and is then combined with the first driving current I1 to pass current through the load 80. When the first driving current I1 is excessive, the excess current I4 (current I2) is branched from the first driving current I1 by the transistor Q3, so that a current resulting from the subtraction of the excess from the first driving current I1 flows through the load 80. Thus, the combined current of the currents I1 and I2 quickly converges at a constant current corresponding to the input voltage Vin.

As shown in FIG. 4, when the current I1 converges at the constant current, the voltage of the second difference detection signal V7 becomes zero to control the current I2 so as to make the current I2 zero, and then the voltage of the third difference detection signal V8 becomes zero to turn off the transistors Q2 and Q3. Thus, the constant current is supplied to the load 80, and the transistors Q2 and Q3 are both turned off to suppress power consumption in the second driver circuit 202.

Second Embodiment

Figure 5:
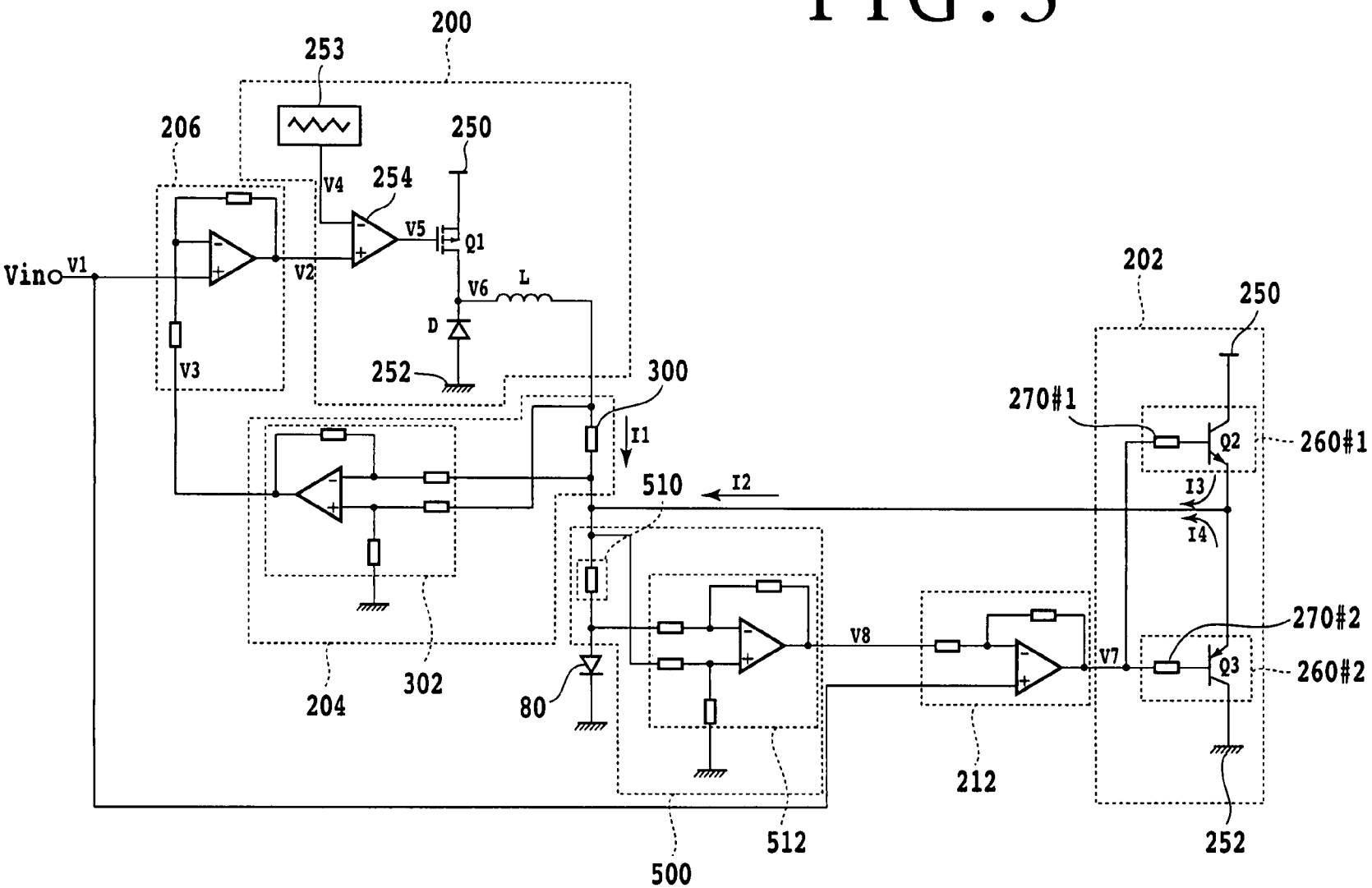
FIG. 5 is a diagram of a configuration of a constant current driving circuit according to a second embodiment of the present invention.
Figure 6:
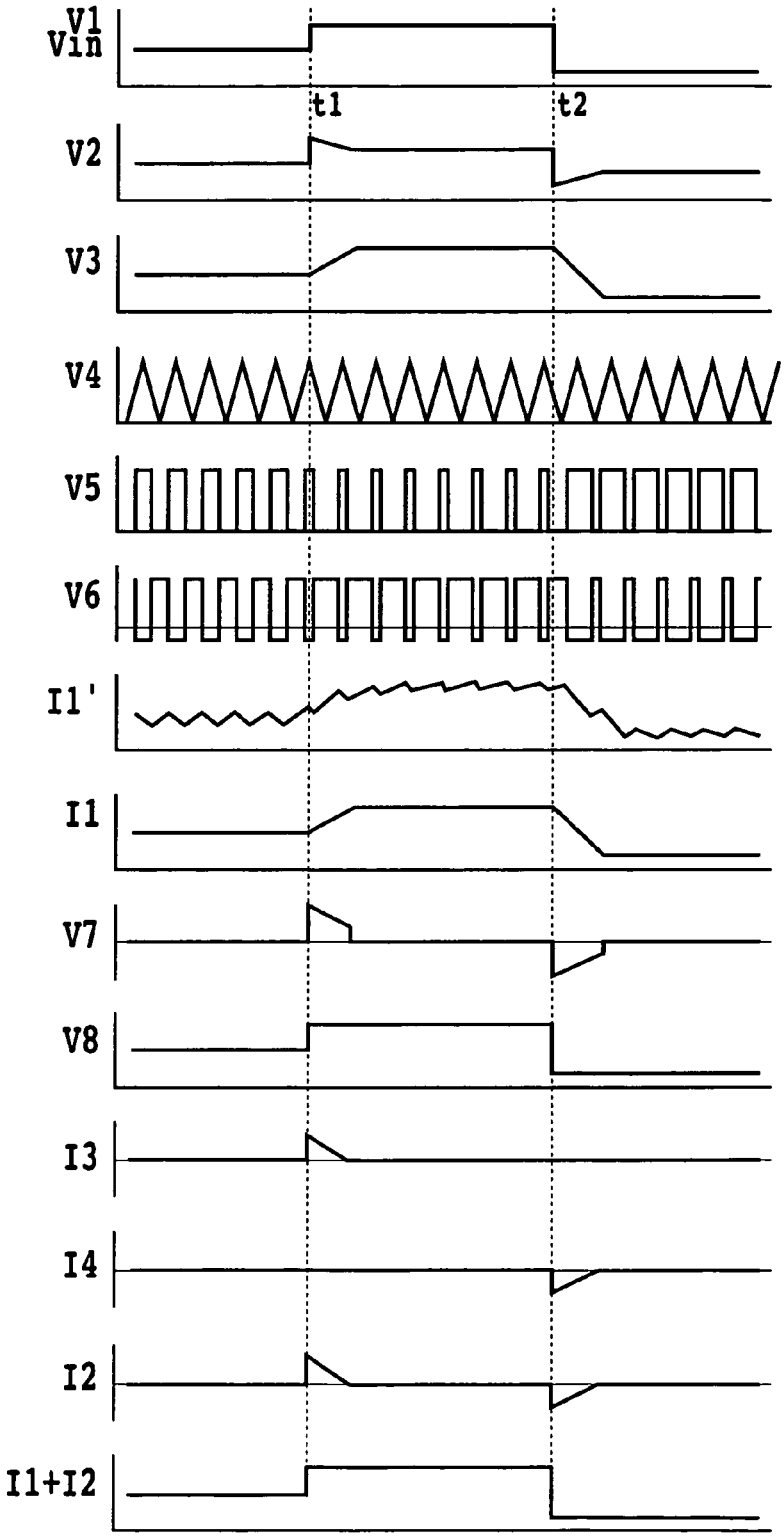
FIG. 6 is a timing chart of FIG. 5.

FIG. 5 is a diagram of a configuration of a constant current driving circuit according to a second embodiment of the present invention. In FIG. 5, substantially the same components as components in FIG. 3 are identified by the same reference numerals. In the second embodiment, a second current detecting circuit 500 outputs a second current detection signal V8 obtained by converting a combined current of driving currents I1 and I2 into voltage to a second difference detecting circuit 502. The second difference detecting circuit 502 outputs a difference voltage V7 between an input voltage V1 and the second current detection signal V8 to a second driver circuit 202. The second current detecting circuit 500 for example includes a monitoring resistance 510 and an operational amplifier 512. The resistance 510 is a monitoring resistance that converts the combined current of the driving current I1 and the driving current I2 into a voltage. The operational amplifier 512 calculates a potential difference across the monitoring resistance 510 to output the second current detection signal V8. FIG. 6 is a timing chart of FIG. 5. Operation in FIG. 5 will be described in the following with reference to FIG. 6.

(1) Driving Current I1

A first driver circuit 200 operates in the same manner as in the first embodiment, and therefore description thereof will be omitted.

(2) Driving Current I2

As shown in FIG. 6, the second current detecting circuit 500 outputs the second current detection signal V8 obtained by converting the combined current of the driving currents I1 and I2 into voltage to the second difference detecting circuit 502. A driving current I2 of the driver 202 is output on the basis of a difference voltage between the input voltage V1 and the second current detection signal V8 obtained by converting the combined current into voltage. Hence, the second difference detecting circuit 502 compares the input voltage V1 with the second current detection signal V8, and then inputs a voltage V7 to make zero a difference between the input voltage V1 and the second current detection signal V8 as shown in FIG. 6 to bases of transistors Q2 and Q3. Since the difference detection signal V7 is substantially the same as in the first embodiment, subsequent description will be omitted. Thus, the same effects as in the first embodiment are obtained.

Third Embodiment

Figure 7:
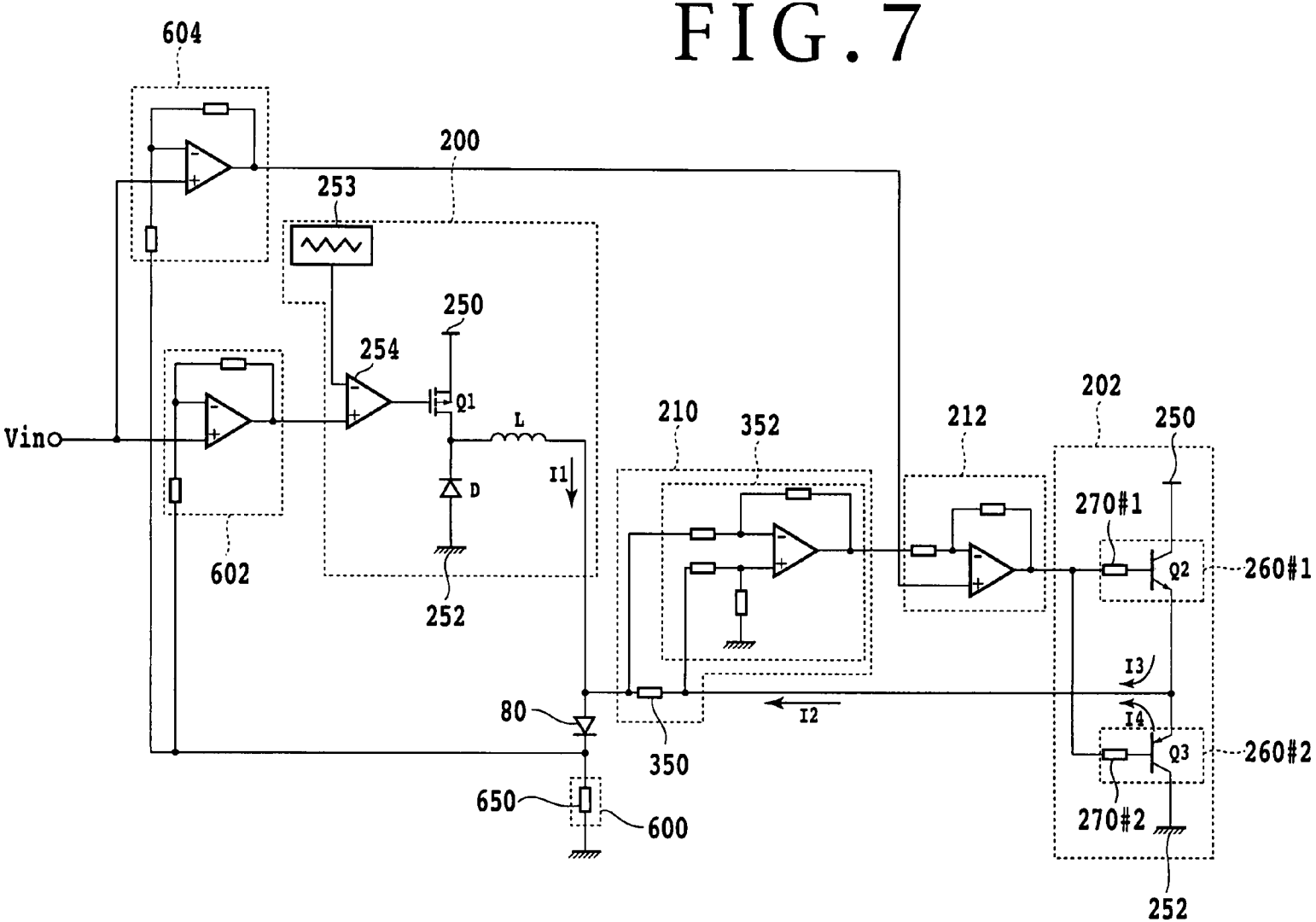
FIG. 7 is a diagram of a configuration of a constant current driving circuit according to a third embodiment of the present invention.

FIG. 7 is a diagram of a configuration of a constant current driving circuit according to a third embodiment of the present invention. In FIG. 7, substantially the same components as components in FIG. 3 are identified by the same reference numerals. In the third embodiment, a first current detecting circuit 600 is formed by a monitoring resistance 650 having one terminal connected to a ground 252 and another terminal connected to a negative terminal of a load 80. The first current detecting circuit 600 outputs a first current detection signal obtained by converting a combined current of driving currents I1 and 12 into voltage. A first difference detecting circuit 602 outputs a first difference detection signal to make zero a difference between an input voltage Vi and the first current detection signal. A second difference detecting circuit 604 calculates a difference between the input voltage Vi and the first current detection signal to output a second difference detection signal. A first driver circuit 200 controls the driving current I1 such that the combined current of the driving current I1 and the driving current I2 coincides with a constant current. When the combined current coincides with the constant current, the driving current 12 is controlled to be zero by a second driver circuit 202. Thus, the current I2 is controlled to be increased or decreased by an amount corresponding to a decrease or an increase in the current I1. Then the driving current I1 coincides with the constant current, and the driving current I2 is controlled to become zero. When the driving current I2 becomes zero, transistors Q2 and Q3 are both turned off, so that power consumption of the second driver circuit 202 is suppressed. A positive side of the load 80 is connected to output sides of the first driver circuit 200 and the second driver circuit 202, and a negative side of the load 80 is connected to the other terminal of the monitoring resistance 650. It is thereby possible to simplify a circuit configuration of the first current detecting circuit 600.

Fourth Embodiment

Figure 8:
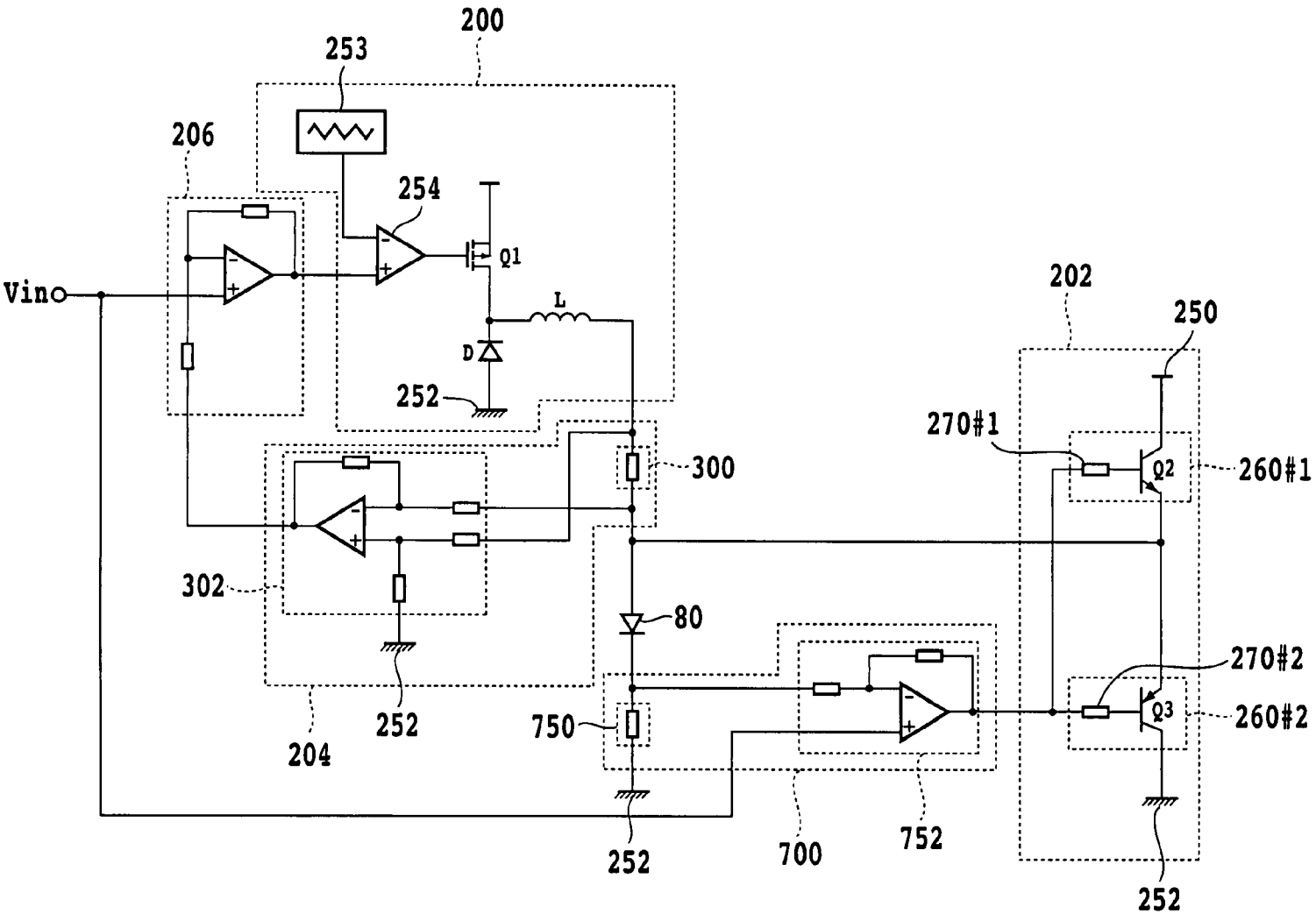
FIG. 8 is a diagram of a configuration of a constant current driving circuit according to a fourth embodiment of the present invention.

FIG. 8 is a diagram of a configuration of a constant current driving circuit according to a fourth embodiment of the present invention. In FIG. 8, substantially the same components as components in FIG. 3 are identified by the same reference numerals. In the fourth embodiment, a second current detecting circuit 700 is formed by a monitoring resistance 750 having one terminal connected to a ground 252 and another terminal connected to a negative terminal of a load 80. The second current detecting circuit 700 outputs a second current detection signal obtained by converting a combined current of driving currents I1 and 12 into voltage. A positive side of the load 80 is connected to output sides of a first driver circuit 200 and a second driver circuit 202, and a negative side of the load 80 is connected to the other terminal of the monitoring resistance 750. It is thereby possible to simplify a circuit configuration of the second current detecting circuit 700. Operation in FIG. 7 is substantially the same as in the operation of the second embodiment.

Fifth Embodiment

Figure 9:
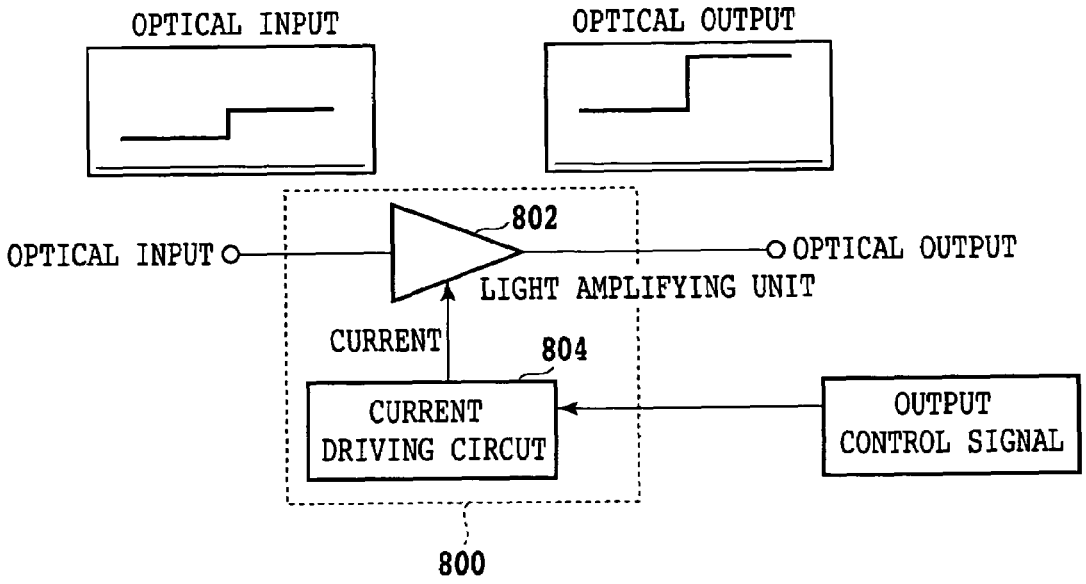
FIG. 9 is a diagram of a configuration of a light amplifier according to a fifth embodiment of the present invention.

FIG. 9 is a diagram of a configuration of a light amplifier according to a fifth embodiment of the present invention. As shown in FIG. 9, the light amplifier 800 is a semiconductor light amplifier, and includes a light amplifying unit 802 and a current driving circuit 804. The light amplifying unit 802 has a function of giving a gain or output corresponding to a value of a driving current to an optical input signal. The current driving circuit 804 is one of the current driving circuits according to the first to fourth embodiments of the present invention. The current driving circuit 804 is supplied with a gain or an output control signal as an input voltage externally or from within the light amplifier 800. The light amplifier 800 performs substantially constant gain operation in a state of constant current. When the light amplifier 800 is made to perform constant output operation without performing constant gain operation, the output control signal (Vin) corresponding to the optical output is generated, whereby rapid optical output control can be realized by the current driving circuit 804. Hence, when constant output control is performed, an optical output monitoring unit not shown in the figure is provided in a stage succeeding an optical output terminal, and an output of the optical output monitoring unit is compared with a reference voltage corresponding to a desired output to generate the output control signal (Vin). An output side of the current driving circuit 804 is connected to the light amplifying unit 802.

Sixth Embodiment

Figure 10:
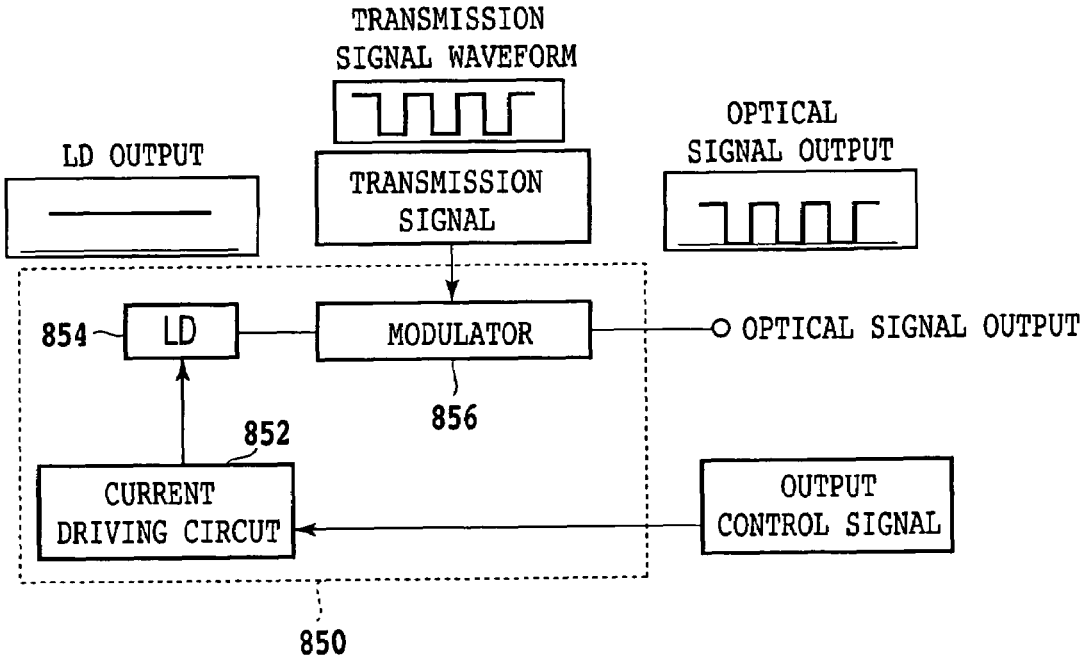
FIG. 10 is a diagram of a configuration of a signal light source according to a sixth embodiment of the present invention.

FIG. 10 is a diagram showing an example of a configuration of a signal light source according to a sixth embodiment of the present invention. As shown in FIG. 10, the signal light source 850 includes a current driving circuit 852, a semiconductor laser (LD) 854, and a modulator 856. By performing constant optical output control in the signal light source 850, it is possible to suppress variations in the LD and the modulator. The current driving circuit 852 is one of the current driving circuits according to the first to fourth embodiments. An output side of the current driving circuit 852 is connected to a positive electrode of the LD 854. The LD 854 emits laser light with a power corresponding to a driving current of the current driving circuit 852. The modulator 856 is externally supplied with a transmission signal, modulates the input signal light from the LD 854 by the transmission signal, and then outputs an optical signal. The output of the signal light source can be controlled by supplying the current driving circuit 852 with an output control signal externally or from within the signal light source 850. When constant output control is performed, an optical output monitoring unit not shown in the figure is provided in a stage succeeding an optical output terminal, and an output of the optical output monitoring unit is compared with a reference voltage corresponding to a desired output to generate the output control signal (Vin).

Seventh Embodiment

Figure 11:
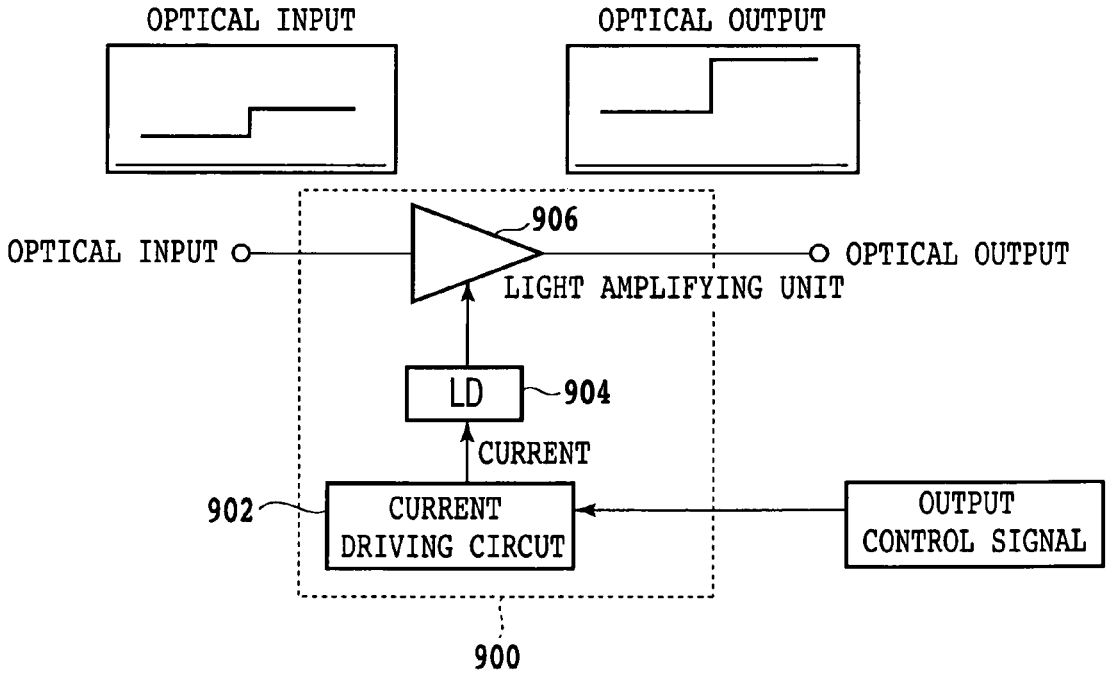
FIG. 11 is a diagram of a configuration of a light amplifier according to a seventh embodiment of the present invention.

FIG. 11 is a diagram showing an example of a configuration of a light amplifier according to a seventh embodiment of the present invention. As shown in FIG. 11, the light amplifier 900 includes a current driving circuit 902, an LD 904, and a light amplifying unit 906. The current driving circuit 902 is one of the current driving circuits according to the first to fourth embodiments. An output side of the current driving circuit 902 is connected to a positive electrode of the LD 904. The current driving circuit 902 current-drives the LD 904. An optical output from the LD 904 is input to the light amplifying unit 906. The light amplifying unit 906 outputs optical output with a gain corresponding to the optical output from the LD 904. The gain or the output of the light amplifier 900 can be controlled by supplying the current driving circuit 902 with a gain or an output control signal externally or from within the light amplifier 900. The light amplifier 900 of this configuration includes an EDFA (Erbium Doped Fiber Amp) using an optical fiber for an amplification medium, a Raman Amp using Raman effect, and the like. The output control signal is the same as in the fifth embodiment.

Eighth Embodiment

Figure 12:
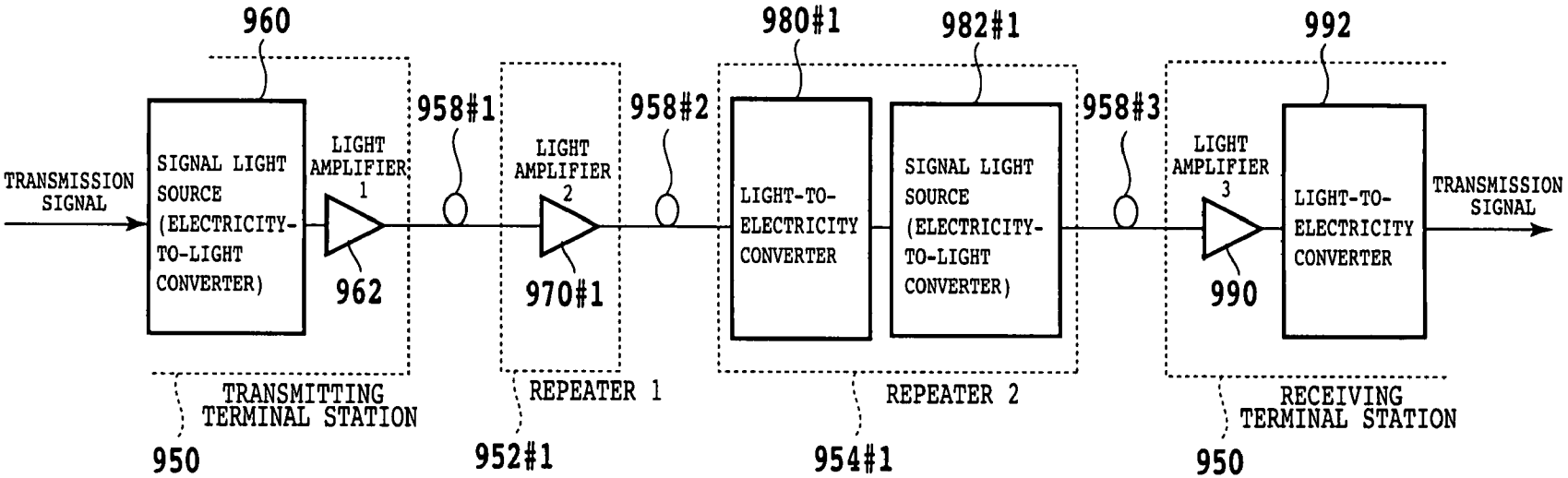
FIG. 12 is a diagram of a configuration of an optical communication system according to an eighth embodiment of the present invention.
Figure 13A:
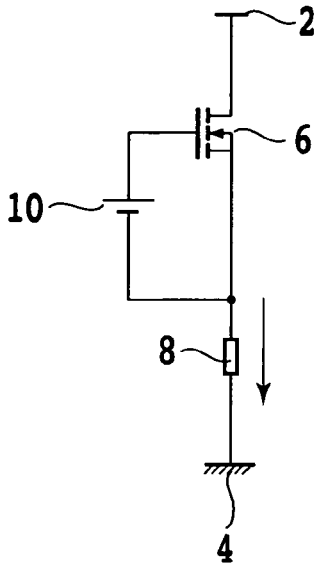
FIG. 13A is a diagram of a configuration of a conventional constant current driving circuit.
Figure 13B:
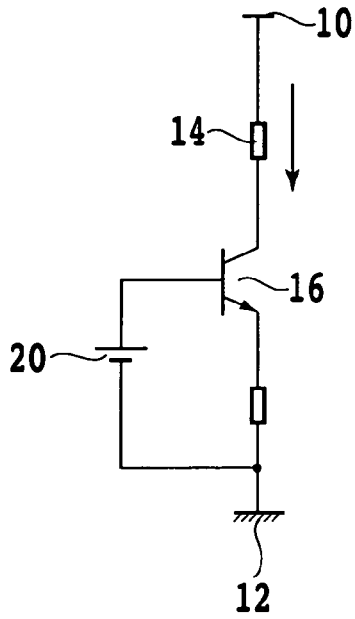
FIG. 13B is a diagram of a configuration of a conventional constant current driving circuit.
Figure 14:
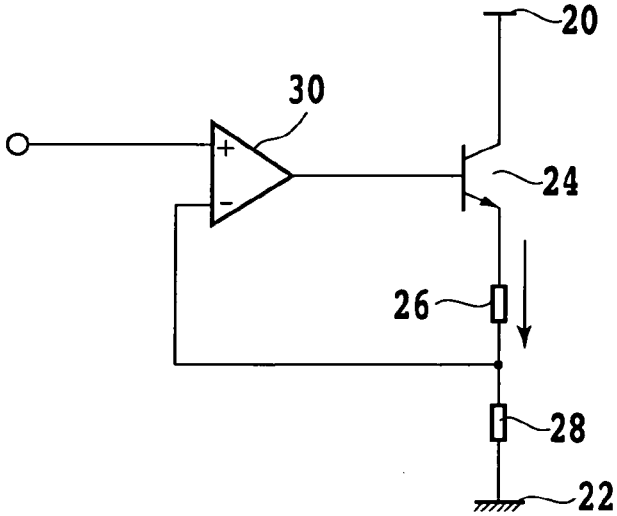
FIG. 14 is a diagram of a configuration of a conventional constant current driving circuit.
Figure 15:
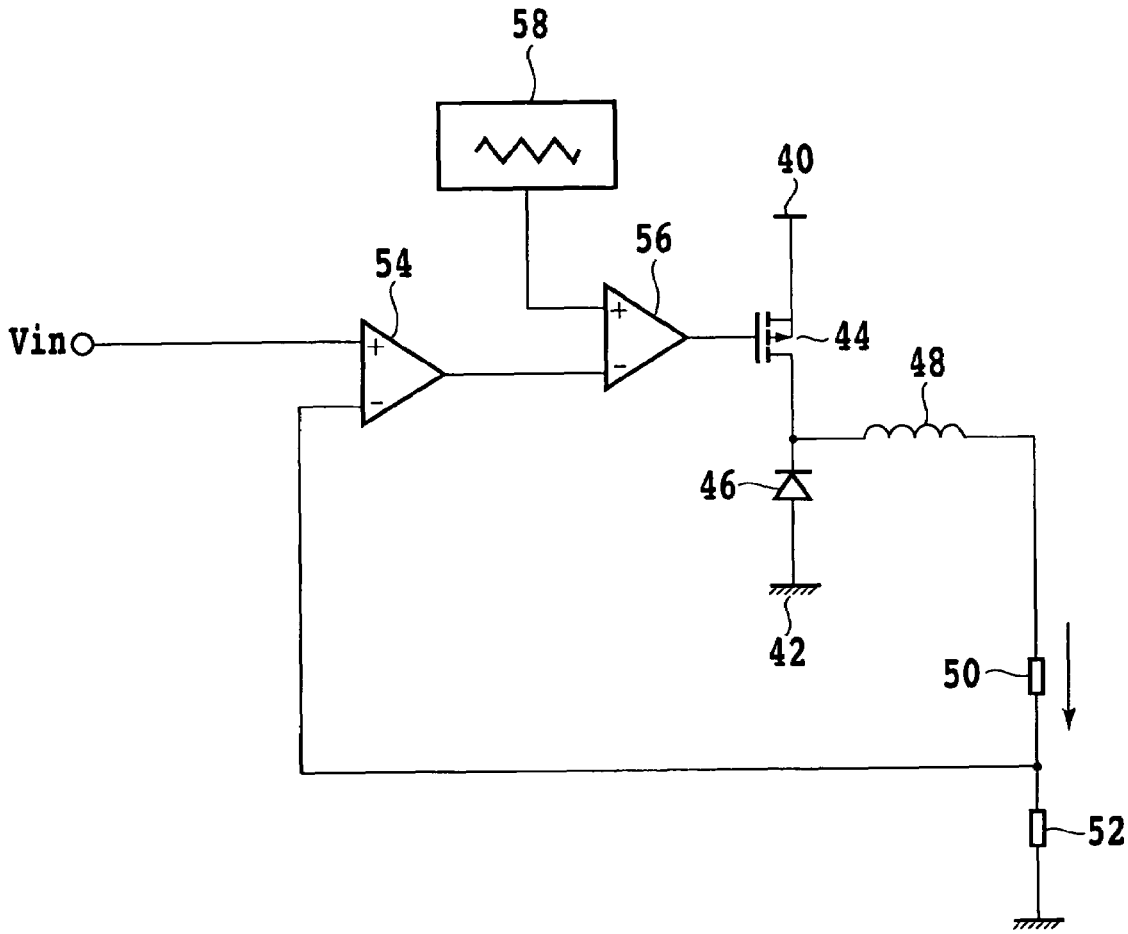
FIG. 15 is a diagram of a configuration of a conventional constant current driving circuit.

FIG. 12 is a diagram showing an example of configuration of an optical communication system according to an eighth embodiment of the present invention. As shown in FIG. 12, the optical communication system includes a transmitting terminal station 950, a first repeater 952#i (i=1 . . . ), a second repeater 954#i (i=1 . . . ), and a receiving terminal station 956. The optical communication system transmits a transmission signal from the transmitting terminal station 950 to the receiving terminal station 956. The transmitting terminal station 950 has a signal light source 960 and a light amplifier 962. The signal light source 960 is substantially the same as the signal light source 850 in FIG. 10. The light amplifier 962 is substantially the same as the light amplifier 800 in FIG. 9 or the light amplifier 900 in FIG. 11. The first repeater 952#i has a light amplifier 970#i. The light amplifier 970#i is substantially the same as the light amplifier 800 in FIG. 9 or the light amplifier 900 in FIG. 11. The second repeater 954#i has a light-to-electricity converter 980#i and a signal light source 982#i. The light-to-electricity converter 980#i performs light-to-electricity conversion. The signal light source 982#i is substantially the same as the signal light source 850 in FIG. 10. The receiving terminal station 956 has a light amplifier 990 and a light-to-electricity converter 992. The light amplifier 990 is substantially the same as the light amplifier 800 in FIG. 9 or the light amplifier 900 in FIG. 11. The light-to-electricity converter 992 performs light-to-electricity conversion.

A transmission signal is input to the signal light source 960 within the transmitting terminal station 950, amplified by the light amplifier 962, and then input to a transmission line fiber 958#1. The optical signal transmitted and attenuated in the transmission line fiber 958#1 is input to the light amplifier 970#1 within the first repeater 952#1 to be amplified, and then input to a transmission line fiber 958#2. The optical signal transmitted and attenuated in the transmission line fiber 958#2 is input to the light-to-electricity converter 980#1 within the second repeater 954#1. The optical signal is temporarily converted into an electric signal by the light-to-electricity converter 980#1, thereafter converted into an optical signal by the signal light source 982#1, and then input to a transmission line fiber 958#3. The optical signal transmitted and attenuated in the transmission line fiber 958#3 is input to the light amplifier 990 within the receiving terminal station 956 to be amplified, and then converted into electricity by the light-to-electricity converter 992 so that the transmission signal is transmitted. Incidentally, the light amplifiers 962, 970#1, and 990 may not be used in the example of configuration of the optical communication system. Also, the repeater 954#i may be configured with a light amplifier on a receiving side and configured with a light amplifier on a transmitting side.

According to the present invention described above, it is possible to realize a driving circuit that can respond quickly while suppressing unnecessary circuit power consumption in high current driving, and thus reduce power consumption without inviting degradation in characteristics in a field of optical communication. It is consequently possible to realize a smaller-size and lower-cost device without requiring circuit parts ready for high power and an additional heat radiation structure.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A constant current driving circuit for supplying a constant current to a load circuit, said constant current driving circuit comprising:

a first driver circuit having a pulse width converting circuit for converting a first difference detection signal into a pulse signal having a pulse width corresponding to a signal level of the first difference detection signal, a switch turned on/off on a basis of said pulse signal, and a smoothing circuit for supplying a smoothed first load current to said load circuit;

a first current detecting circuit for converting said first load current into a first voltage corresponding to said first load current, and outputting a first current detection signal;

a second driver circuit for supplying a second load current to said load circuit on a basis of a signal level of a second difference detection signal;

a second current detecting circuit for converting said second load current into a second voltage corresponding to said second load current, and outputting a second current detection signal;

a first difference detecting circuit for calculating said first difference detection signal to make zero a difference between said first current detection signal and an input voltage;

a second difference detecting circuit for detecting a difference voltage between said first current detection signal and the input voltage, and outputting a third difference detection signal; and a third difference detecting circuit for detecting a difference voltage between said third difference detection signal and said second current detection signal, and outputting said second difference detection signal.

2. A constant current driving circuit for supplying a constant current to a load circuit, said constant current driving circuit comprising:

a first driver circuit having a pulse width converting circuit for converting a first difference detection signal into a pulse signal having a pulse width corresponding to a signal level of the first difference detection signal, a switch turned on/off on a basis of said pulse signal, and a smoothing circuit for supplying a smoothed first load current to said load circuit;

a first current detecting circuit for converting said first load current into a first voltage corresponding to said first load current, and outputting a first current detection signal;

a second driver circuit for supplying a second load current to said load circuit on a basis of a signal level of a second difference detection signal;

a second current detecting circuit for converting a combined load current of said first load current and said second load current into a second voltage corresponding to the combined load current of said first load current and said second load current, and outputting a second current detection signal;

a first difference detecting circuit for calculating said first difference detection signal to make zero a difference between said first current detection signal and an input voltage; and a second difference detecting circuit for detecting a difference voltage between said first difference detection signal and said second current detection signal, and outputting said second difference detection signal.

3. A constant current driving circuit for supplying a constant current to a load circuit, said constant current driving circuit comprising:

a first driver circuit having a pulse width converting circuit for converting a first difference detection signal into a pulse signal having a pulse width corresponding to a signal level of the first difference detection signal, a switch turned on/off on a basis of said pulse signal, and a smoothing circuit for supplying a smoothed first load current to said load circuit;

a second driver circuit for supplying a second load current to said load circuit on a basis of a signal level of a second difference detection signal;

a first current detecting circuit for converting a combined current of said first load current and said second load current into a first voltage corresponding to the combined current of said first load current and said second load current, and outputting a first current detection signal;

a second current detecting circuit for converting said second load current into a second voltage corresponding to said second load current, and outputting a second current detection signal;

a first difference detecting circuit for calculating said first difference detection signal to make zero a difference between said first current detection signal and an input voltage;

a second difference detecting circuit for detecting a difference voltage between said first current detection signal and the input voltage, and outputting a third difference detection signal; and a third difference detecting circuit for detecting a difference voltage between said third difference detection signal and said second current detection signal, and outputting said second difference detection signal.

4. The constant current driving circuit as claimed in claim 1, wherein said second driver includes:

a first transistor for supplying or stopping supplying the second load current to said load circuit according to the signal level of said second difference detection signal; and a second transistor for absorbing or stopping absorbing a part of said first load current according to the signal level of said second difference detection signal.

5. The constant current driving circuit as claimed in claim 2, wherein said second driver includes:

a first transistor for supplying or stopping supplying the second load current to said load circuit according to the signal level of said second difference detection signal; and a second transistor for absorbing or stopping absorbing a part of said first load current according to the signal level of said second difference detection signal.

6. The constant current driving circuit as claimed in claim 3, wherein said second driver includes:

a first transistor for supplying or stopping supplying the second load current to said load circuit according to the signal level of said second difference detection signal; and a second transistor for absorbing or stopping absorbing a part of said first load current according to the signal level of said second difference detection signal.

7. A light amplifier comprising:

a light amplifying unit for amplifying an optical input signal on a basis of a driving current; and the constant current driving circuit of claim 1 for receiving, as said input voltage, an output control signal for performing control to attain a desired optical power of optical output of said light amplifying unit on a basis of the optical power, and outputting a combined current of said first load current and said second load current as said driving current.

8. A light amplifier comprising:

a light amplifying unit for amplifying an optical input signal on a basis of a driving current; and the constant current driving circuit of claim 2 for receiving, as said input voltage, an output control signal for performing control to attain a desired optical power of optical output of said light amplifying unit on a basis of the optical power, and outputting the combined current of said first load current and said second load current as said driving current.

9. A light amplifier comprising:

a light amplifying unit for amplifying an optical input signal on a basis of a driving current; and the constant current driving circuit of claim 3 for receiving, as said input voltage, an output control signal for performing control to attain a desired optical power of optical output of said light amplifying unit on a basis of the optical power, and outputting the combined current of said first load current and said second load current as said driving current.

10. A signal light source comprising:

a semiconductor laser for outputting an optical signal on a basis of a driving current;

a modulator for modulating said optical signal on a basis of a transmission signal and outputting the modulated optical signal; and the constant current driving circuit of claim 1 for receiving, as said input voltage, an output control signal for performing control to attain a desired optical power of the modulated optical signal of said modulator, and outputting a combined current of said first load current and said second load current as said driving current.

11. A signal light source comprising:

a semiconductor laser for outputting an optical signal on a basis of a driving current;

a modulator for modulating said optical signal on a basis of a transmission signal and outputting the modulated optical signal; and the constant current driving circuit of claim 2 for receiving, as said input voltage, an output control signal for performing control to attain a desired optical power of the modulated optical signal of said modulator, and outputting the combined current of said first load current and said second load current as said driving current.

12. A signal light source comprising:

a semiconductor laser for outputting an optical signal on a basis of a driving current;

a modulator for modulating said optical signal on a basis of a transmission signal and outputting the modulated optical signal; and the constant current driving circuit of claim 3 for receiving, as said input voltage, an output control signal for performing control to attain a desired optical power of the modulated optical signal of said modulator, and outputting the combined current of said first load current and said second load current as said driving current.

13. A light amplifier comprising:

a semiconductor laser for outputting an optical signal on a basis of a driving current;

a light amplifying unit for amplifying an optical input signal; and the constant current driving circuit of claim 1 for receiving, as said input voltage, an output control signal for performing control to attain a desired optical power of optical output of said light amplifying unit, and outputting a combined current of said first load current and said second load current as said driving current.

14. A light amplifier comprising:

a semiconductor laser for outputting an optical signal on a basis of a driving current;

a light amplifying unit for amplifying an optical input signal; and the constant current driving circuit of claim 2 for receiving, as said input voltage, an output control signal for performing control to attain a desired optical power of optical output of said light amplifying unit, and outputting the combined current of said first load current and said second load current as said driving current.

15. A light amplifier comprising:

a semiconductor laser for outputting an optical signal on a basis of a driving current;

a light amplifying unit for amplifying an optical input signal; and the constant current driving circuit of claim 3 for receiving, as said input voltage, an output control signal for performing control to attain a desired optical power of optical output of said light amplifying unit, and outputting the combined current of said first load current and said second load current as said driving current.

16. An optical communication system comprising:

a transmitting terminal station having the light amplifier of claim 7 for amplifying a transmission signal;

a first repeater having the light amplifier of claim 7 for amplifying the received optical signal;

a second repeater having the signal light source of claim 10; and a receiving terminal station having the light amplifier of claim 7 for amplifying the received signal.

17. An optical communication system comprising:

a transmitting terminal station having the light amplifier of claim 13 for amplifying a transmission signal;

a first repeater having the light amplifier of claim 13 for amplifying the received optical signal;

a second repeater having the signal light source of claim 10; and a receiving terminal station having the light amplifier of claim 13 for amplifying the received signal.

18. The constant current driving circuit as claimed in claim 1, wherein said load circuit has one terminal grounded;

said first current detecting circuit includes a first resistance having one terminal connected to an output side of said first driver circuit and another terminal connected to another terminal of said load circuit; and said second current detecting circuit includes a second resistance having one terminal connected to an output side of said second driver circuit and another terminal connected to the other terminal of said load circuit.

19. The constant current driving circuit as claimed in claim 2, wherein said load circuit has one terminal grounded;

said first current detecting circuit includes a first resistance having one terminal connected to an output side of said first driver circuit and another terminal connected to an output side of said second driver circuit; and said second current detecting circuit includes a second resistance having one terminal connected to the other terminal of said first resistance and another terminal connected to another terminal of said load circuit.

20. The constant current driving circuit as claimed in claim 2, wherein said load circuit has one terminal connected to an output side of said first driver circuit and an output side of said second driver circuit;

said first current detecting circuit includes a first resistance having one terminal connected to the output side of said first driver circuit and another terminal connected to the output side of said second driver circuit; and said second current detecting circuit includes a second resistance having one terminal connected to another terminal of said load circuit and another terminal grounded.

21. The constant current driving circuit as claimed in claim 3, wherein said load circuit has one terminal connected to an output side of said first driver circuit and an output side of said second driver circuit;

said first current detecting circuit includes a first resistance having one terminal connected to another terminal of said load circuit and another terminal grounded; and said second current detecting circuit includes a second resistance having one terminal connected to the output side of said second driver circuit and another terminal connected to the one terminal of said load circuit.

* * * * *